US005647722A

United States Patent [19]

Cartner

[11] Patent Number: 5,647,722

[45] Date of Patent: *Jul. 15, 1997

[54] DUAL CYLINDER ACTUATED BOOM ARM

[76] Inventor: Jack O. Cartner, 1005 N. 8th St., Cambridge, Ohio 43725

[ * ] Notice: The term of this patent shall not extend beyond the expiration date of Pat. No. 5,292,220.

[21] Appl. No.: 616,758

[22] Filed: Mar. 15, 1996

Related U.S. Application Data

[63] Continuation of Ser. No. 206,387, Mar. 4, 1994, abandoned, which is a continuation-in-part of Ser. No. 865,912, Apr. 9, 1992, Pat. No. 5,292,220, which is a continuation of Ser. No. 635,364, Dec. 28, 1990, abandoned.

[51] Int. Cl.[6] ..... E02F 9/24

[52] U.S. Cl. ..... 414/687; 91/401

[58] Field of Search ..... 414/687, 690, 414/694, 695.5, 730; 172/200.5; 91/401, 170 R, 517

[56] References Cited

U.S. PATENT DOCUMENTS

| | | |
|---|---|---|
| 3,653,193 | 4/1972 | Coughran, Jr. . |
| 3,949,539 | 4/1976 | Cartner . |
| 3,991,832 | 11/1976 | Cooper . |
| 4,007,845 | 2/1977 | Worback . |
| 4,039,010 | 8/1977 | Tucek . |
| 4,048,789 | 9/1977 | Cartner . |
| 4,065,010 | 12/1977 | Worback . |
| 4,095,436 | 6/1978 | Heitkamp et al. . |
| 4,249,614 | 2/1981 | van der Lely . |
| 4,495,754 | 1/1985 | Cartner . |
| 4,506,464 | 3/1985 | Cartner . |
| 4,725,187 | 2/1988 | Morelli . |

*Primary Examiner*—Donald W. Underwood

*Attorney, Agent, or Firm*—Fay, Sharpe, Beall, Fagan, Minnich & McKee

[57] ABSTRACT

A linkage mechanism which allows a substantially 180° pivoting motion of a frame, and hence a boom arm secured to the frame, around the frame's pivot axis includes a mast to which the frame is fixedly secured, the mast being pivotably mounted on a pivot axis to an associated support frame. First and second hydraulic cylinders, each having a piston rod end and a cylinder end, are connected to respective sides of the mast. A control member is operatively associated with the first and second hydraulic cylinders for effecting a linear movement of the piston rods thereof and hence a pivotal movement of the mast and thus the boom arm secured to the mast about the mast's pivot axis. An overload protection circuit is connected to at least one of the first and second hydraulic cylinders such that the mast, and the frame and boom arm, will pivot around the pivot axis in the event an associated tool secured to the boom arm meets an obstruction. This avoids damage to the associated tool as well as the boom arm. Also provided is a mechanism for selectively disabling the overload protection circuit.

21 Claims, 8 Drawing Sheets

DUAL CYLINDER ACTUATED BOOM ARM

This is a file-wrapper continuation of application Ser. No. 08/206,387 filed on Mar. 4, 1994 and now abandoned. Application Ser. No. 08/206,887 is a continuation-in-part of application Ser. No. 07/865,912 filed on Apr. 9, 1992 and which issued as U.S. Pat. No. 5,292,220 on Mar. 8, 1994. Application Ser. No. 08/865,912 is a continuation of application Ser. No. 07/635,364 filed on Dec. 28, 1990 and now abandoned.

BACKGROUND OF THE INVENTION

The present invention relates to earth working equipment. More particularly this invention relates to a boom arm pivoting linkage mechanism which is used on such an earth working device.

The invention finds particular application in the cleaning and maintaining of road shoulders or berms where vegetation needs to be cut or soil or debris need to be moved, and will be described with reference thereto. However, it should be appreciated that the invention also finds application in other boom arm environments.

Heretofore, road maintenance equipment, such as mowing apparatus, has been connected with prime movers such as tractors in various ways. Articulated boom assemblies have been found to be particularly advantageous for supporting mowing apparatus on tractors or the like. Such a boom assembly includes a plurality of arms, a first of which is pivotally connected with tee tractor and a second of which is pivotally connected between the mowing apparatus and the first arm. Hydraulic cylinders are provided to control the angular orientation of the first arm relative to the tractor and the second arm relative to the first arm.

One particular known mechanism employs a pair of hydraulic cylinders in order to enable a pivoting motion of a boom arm, to which a rotary cutting mechanism was secured, over substantially 180° of motion. However, this mechanism was not tied in with a breakaway system so that if an obstruction is encountered by, e.g., an earth working device secured to the free end of a boom arm, the boom assembly could pivot the earth working device away from the obstruction before any damage would be caused to either the earth working device or the boom mechanism. In addition, the known mechanism is fairly large in size and is adapted only for use on a rear end of a construction vehicle.

It would be advantageous to have a linkage mechanism which would allow a substantially 180° pivoting motion of a boom arm around a pivot axis, which includes an overload protection circuit and a means responsive to a movement of a piston for selectively disabling the overload protection circuit.

Accordingly, it has been considered desirable to develop a new and improved linkage mechanism for a pivotable boom arm which would overcome the foregoing difficulties and others and meet the above stated needs while providing better and more advantageous overall results.

BRIEF SUMMARY OF THE INVENTION

In accordance with the present invention, a new and improved linkage mechanism is provided which allows a substantially 180° pivoting motion of a boom arm around a pivot axis.

More particularly in accordance with this aspect of the invention, the linkage mechanism comprises a mast which is pivotably mounted on a pivot axis to an associated support frame, the boom arm being secured at a first end to the mast and supporting on a second end an associated tool. A first hydraulic cylinder including a piston and a piston rod and having a piston rod end and a cylinder end has one of the ends being pivotably secured to a first side of the mast and the other end being secured to the associated support frame. An overload protection circuit is connected to the first hydraulic cylinder such that the mast and the boom arm will pivot around the pivot axis in the event the associated tool meets an obstruction. The mast will pivot away from the obstruction in order to avoid damaging the associated tool. A control means is connected to the first hydraulic cylinder for effecting a linear movement of the piston rod and a pivotal movement of the mast, and hence the boom arm secured thereto, about the mast's pivot axis. A means responsive to the movement of the piston disables the overload protection circuit. The means for disabling is controlled by a fluid pressure in the first hydraulic cylinder.

One advantage of the present invention is the provision of a new and improved boom arm pivoting mechanism.

Another advantage of the present invention is the provision of an earth working machine which includes a linkage mechanism that allows a substantially 180° pivoting motion of a boom arm supported on the machine in relation to the machine.

Still another advantage of the present invention is the provision of an actuating mechanism which includes a pair of hydraulic cylinders with at least one of the cylinders being provided with an overload protection circuit.

An additional advantage of the present invention is the provision of an actuating mechanism including a pair of hydraulic cylinders as well as an overload protection circuit for at least one of them in which a means is provided for selectively disabling the overload protection circuit.

A further advantage of the present invention is the provision of an actuating mechanism having an overload protection circuit which can be selectively disengaged, wherein the overload mechanism is disengaged upon a movement of a piston in a cylinder.

A still further advantage of the present invention is the provision of a means for selectively disengaging an overload protection circuit wherein the means is selectively actuated by a fluid pressure change in a hydraulic cylinder.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 1:
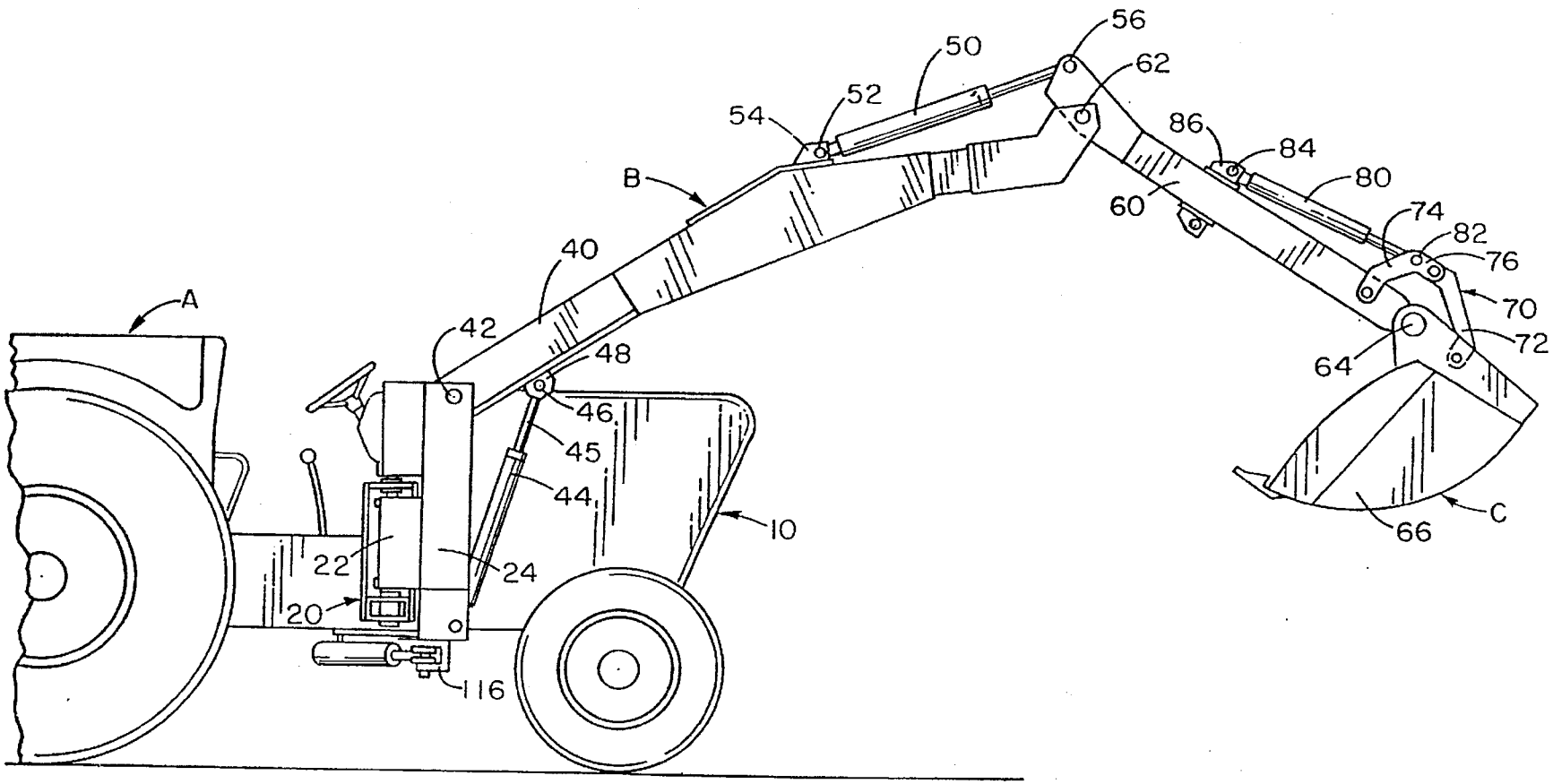
FIG. 1 is a side elevational view of a road maintenance vehicle including a trencher bucket that is secured to a boom assembly attached to the vehicle according to a first preferred embodiment of the present invention.

Referring now to the drawings, wherein the showings are for purposes of illustrating preferred embodiments of the invention only and not for purposes of limiting same, FIG. 1 shows a vehicle A having a boom assembly B to which is secured an earth working mechanism C according to the present invention. While the invention will be described in connection with a vehicle on which a trencher bucket is mounted, it should be appreciated that the invention could be adapted for use in other environments, such as boom arms holding a mower, other equipment for digging, cutting or moving soil as well as boom arms used in other environments.

More specifically, the vehicle A preferably comprises a tractor 10 having secured thereto a saddle frame 20 that extends across the tractor and retains the boom arm assembly B in place. Secured to the frame 20 along one side thereof is a vertical mast 22 comprising a channel frame 24. The vertical mast 22 is mounted on the tractor 10 by frame 20 and is capable of pivoting about a substantially vertical axis. This permits the boom assembly B to rotate fore and aft in relation to the longitudinal axis of the tractor. Such rotation may be in response to impacting large rocks, posts or other stationary objects, if a breakaway mechanism is present. Rotation is also needed to a storage position and to any desired working orientation.

Included in the arm assembly B is an inner boom arm 40 that is secured at a first end by a pivot pin 42 to the channel 24. Positioned in the channel 24 of the vertical mast is a hoist cylinder 44 that is pivotably secured at a first end in the channel member. A piston rod 45 of the hoist cylinder is secured by a pin 46 to a clevis 48 of the inner arm 40. Operably secured to the inner arm 40 is a crowd and retract cylinder 50. In this regard, a first end of the cylinder 50 is rotatably secured by a pin 52 to a clevis 54 located on the inner arm 40. An end pin 56 rotatably secures a piston rod end of the crowd and retract cylinder 50 to an end of an outer boom arm 60. The outer arm 60 is pivotably secured by a pin 62 to the free end of the inner arm 40 and by a pin 64 to a trencher bucket 66 which comprises the earth working mechanism C in this embodiment.

A linkage assembly 70 is provided between the outer arm 60 and the trencher bucket 66. This assembly includes a trunion link 72, as well as an arm link 74 having an elbow section 76. A cylinder 80 having a piston rod that is rotatably secured by a pin 82 to the elbow section 76 of the arm link 74 is provided. A second end of the cylinder is rotatably secured by a pin 84 to a clevis 86 affixed to the outer arm 60.

Figure 2:
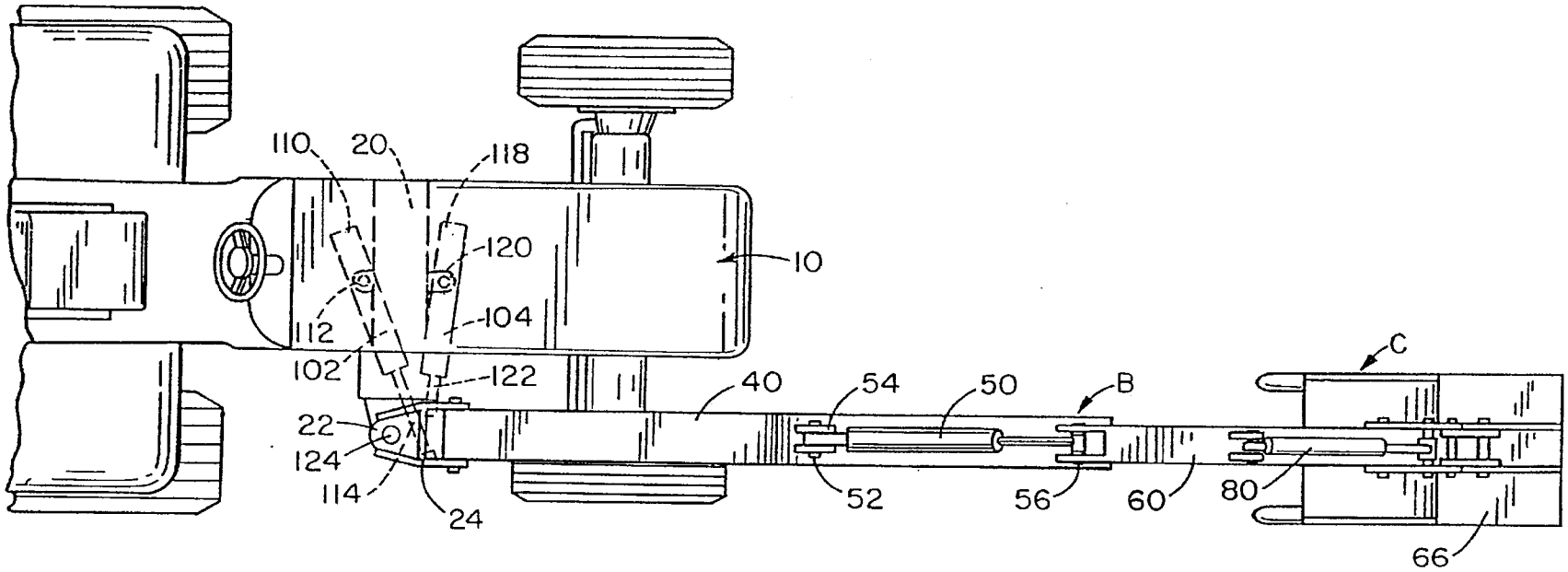
FIG. 2 is an top plan view of the vehicle of FIG. 1.
Figure 2A:
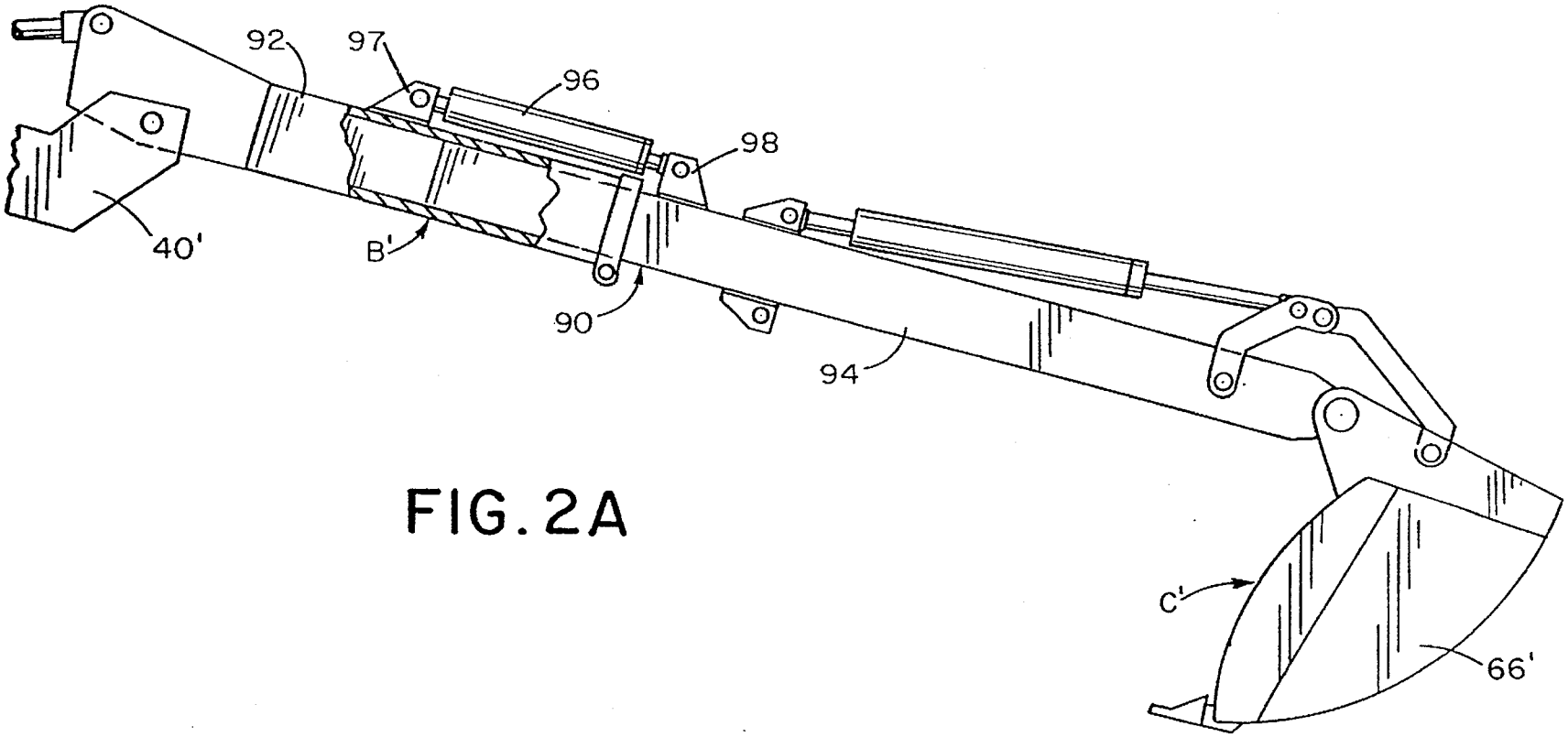
FIG. 2A is an enlarged side elevational view of a portion of a boom assembly according to a first alternate embodiment of the present invention.

With reference now to FIG. 2A, a telescoping boom arm assembly B' is there illustrated. For ease of comprehension and appreciation of this alternative, like components will be identified by like numerals with a primed suffix (') and new components will be identified by new numerals.

In this FIGURE, an outer boom arm 90 is secured to an inner boom arm 40'. The outer boom arm comprises a first section 92 and slidably held therein a second telescoping section 94. A telescoping cylinder 96 is secured by respective first and second clevises 97 and 98 to the first and second sections 92 and 94 of the outer arm assembly 90. Provided at a free end of the second section 94 is a suitable trencher bucket 66' comprising the earth working mechanism C. A telescoping boom arm has been found advantageous for certain applications.

As shown in FIG. 2, a pair of hydraulic swing cylinders 102 and 104 are utilized in order to rotate the boom assembly B of the preferred embodiment. The first swing cylinder 102 has a cylinder end 110 adjacent which the cylinder is pivotably secured to a flange 112 that extends at substantially a right angle to the harness 20. If desired, the cylinder 102 can be pivotably secured to the flange 112 approximately 3 to 4 inches from the cylinder end 110. The cylinder 102 also has a piston rod end 114 which is pivotably secured, through a suitable clevis 116 (FIG. 1) to a first side of the channel frame 24. Similarly, the second cylinder 104 includes a cylinder end 118 adjacent which the cylinder is secured pivotably to a second flange 120 that extends at substantially a right angle to a second side of the saddle frame 20. The second cylinder also includes a piston rod end 122 which is suitably secured to a clevis (not visible) mounted to another side of the frame 24. In this way, a linear motion of the two cylinders 102 and 104 will translate into a pivotal motion of the boom assembly B around a vertical pivot axis 124 of the vertical mast 22 around the saddle frame 20. Due to the location of the pivots for the cylinders 102 and 104 and the flanges 112 and 120, the boom arm B is able to be pivoted somewhat more than 180° around axis 124.

Figure 5:
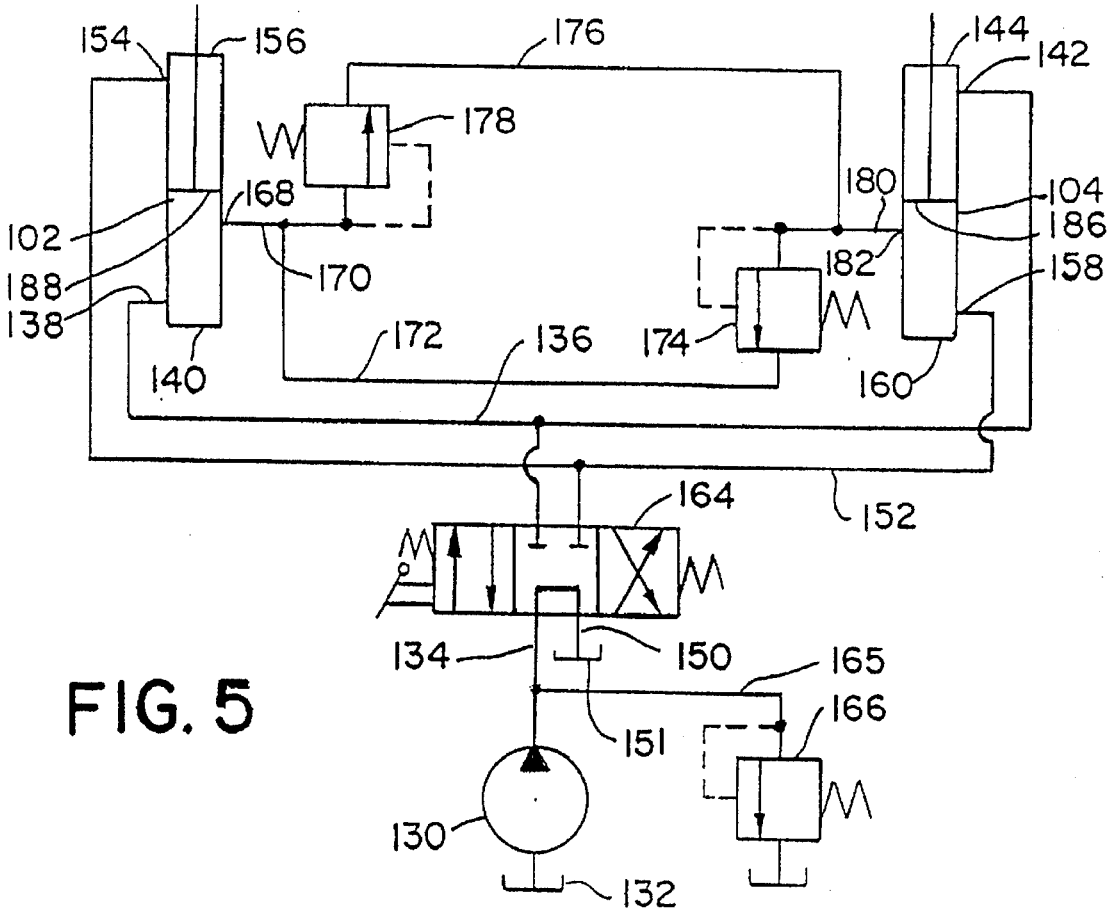
FIG. 5 is a first preferred embodiment of a control means and an overload protection circuit which can be provided for the pair of hydraulic cylinders that are disclosed in FIG. 2 or FIG. 4.

One suitable hydraulic control circuit used to actuate the pair of cylinders 102 and 104 is illustrated in FIG. 5. In this circuit, a pump 130 pressurizes a hydraulic fluid withdrawn from a sump 132 and sends it to a first hydraulic line 134. That line communicates with a second hydraulic line 136 having a first end 138 adjacent a first cylinder free end and a second end 142 adjacent a second cylinder piston rod end 144. In other words, the opposite ends of the first and second cylinders 102 and 104 are connected by the line 136.

A third line 150 extends from a sump 151, which may be the same as the sump 132 or may be a separate sump, to a fourth line 152. The fourth line has a first end 154 that communicates with the cylinder 102 adjacent a piston rod end 156 thereof. The fourth line also has a second end 158 which communicates with the second cylinder 104 adjacent a second cylinder free end 160. In other words, the opposing ends of the first and second cylinders 102 and 104 are connected by the fourth line 152 in the same manner as by the line 136. Regulating the flow of hydraulic fluid to the first line 134 and the third line 150 is a suitable conventional valve 164. In the embodiment illustrated, the valve is a three envelope four way valve having a center neutral or off position and left and right actuated positions as shown. The valve may be spring biased to the center neutral or off position and can be manually moved to either one of the actuated positions. Of course it should be recognized that other suitable valve configurations could also be provided. In addition, the valve can be solenoid actuated if desired, instead of being manually actuated. Communicating with the first line 134 through a relief line 165 is a relief valve 166 as is well known in the art.

Extending from a port 168 on the first cylinder 102, the port preferably being located near the midpoint along the length thereof, is a fifth line 170. Communicating with the fifth line 170 is a sixth line 172 in which is located a second relief valve 174. Also communicating with the fifth line 170 is a seventh line 176 in which is located a third relief valve 178. Communicating with the distal ends of the sixth and seventh lines 172 and 176 is an eighth line 180 that extends to a port 182 on the second cylinder 104, the port preferably being located near the midpoint along the length thereof.

The fifth through eighth lines 170, 172, 176 and 180 as well as the second and third relief valves 174 and 178 serve as a breakaway system for the pair of hydraulic cylinders 102 and 104. The first relief valve 174 permits pressurized hydraulic fluid to flow out of the second cylinder 104 when a pressure limit on the valve 174 is exceeded as a piston 186 in the second cylinder 104 moves downwardly and pressurizes the hydraulic fluid below it. That fluid will flow into line 182 and trip the relief valve 174. The hydraulic fluid will then flow through line 172, through line 170 and into the first cylinder 102 below its piston 188.

The two relief valves 174 and 178 and the associated fluid lines allow the arm assembly B and the earth working device C to swing away in response to a preselected breakaway pressure or force. In other words, the system allows the arm assembly B to swing forward or rearward in response to a preselected breakaway pressure or force. The force to cause the arm assembly, and the ditcher bucket 66 or similar earth working device secured thereto, to break away in a forward direction and in a rearward direction may be the same or different. Such a breakaway assembly will prevent damage to either the boom arm assembly B or the earth working device C when the earth working device, such as the ditcher bucket 66, impacts relatively immoveable objects such as stumps, fenceposts, large rocks or the like.

If desired, the boom operating pressure may be on the order of 1200 psi and the relief valves 174 and 178 may be set to, e.g. 1350 psi for breakaway pressure. Operating pressure for the hydraulic cylinders 102 and 104 can be generally in the range of 1200 to 1800 psi. The breakaway pressure is set just a little bit above the operating pressure of the cylinders. However, the breakaway pressure is set below the maximum hydraulic operating pressure of the main circuit which may be on the order of 2,000 to 2,250 psi. This allows for some tolerance in the circuit.

In the embodiment illustrated in FIG. 5, however, the ports 168 and 182 for the respective cylinders 102 and 104 are located somewhere near the respective center of each of the cylinders. This is advantageous in providing a breakaway feature for the system only when the boom mechanism B is located approximately normal to the longitudinal axis of the vehicle A. In other words, the breakaway feature would exist only for, e.g. 7–10 degrees on either side of an orientation of the boom arm assembly substantially perpendicular to a longitudinal axis of the vehicle A. No breakaway feature would be provided from that point forward and rearward for the swinging movement of the boom arm. Such a limited breakaway feature is advantageous in a situation where the vehicle is located on an inclined surface, e.g. on a hillside berm adjacent a road.

A problem would exist if the vehicle is positioned on an inclined surface and an unlimited breakaway feature is provided. When using the ditcher bucket 66, if the operator were swinging a bucket full of dirt and the breakaway feature inadvertently engages due to centrifugal force, the boom arm assembly would then start swinging uncontrollably and might tip over the vehicle. Accordingly, to prevent such problems the breakaway feature is operative only during a limited degree of movement of the boom arm. The breakaway feature would be disengaged just as soon as the respective piston 188 and 186 of the respective cylinder 102 and 104 passes over its respective port 168 and 182. After that point, the breakaway feature would be disengaged and the boom would not be allowed to swing away even if a hydraulic shock were experienced by the circuit.

Figure 3:
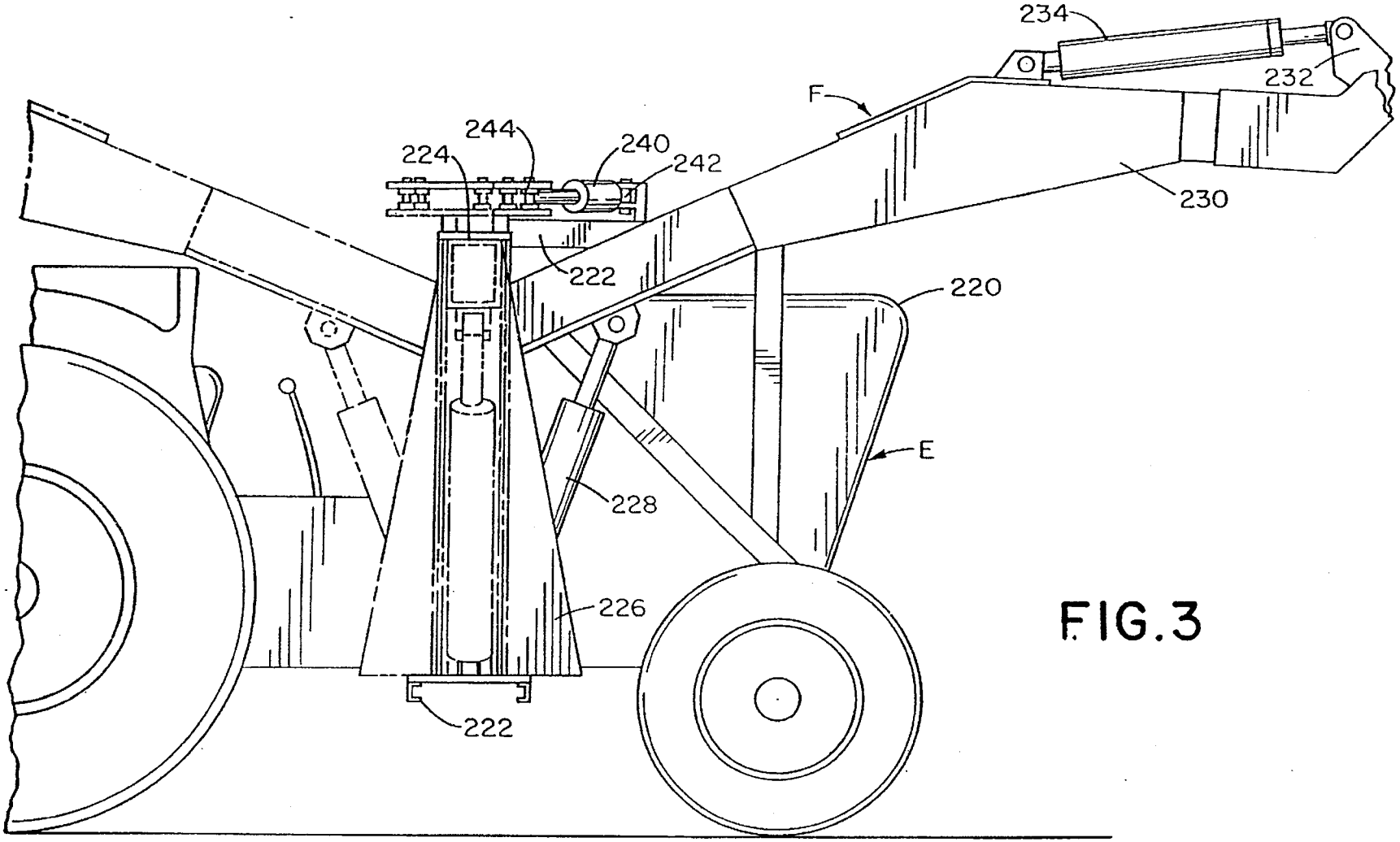
FIG. 3 is a side elevational view of a road maintenance vehicle and boom assembly secured thereto according to a second preferred embodiment of the invention.
Figure 4:
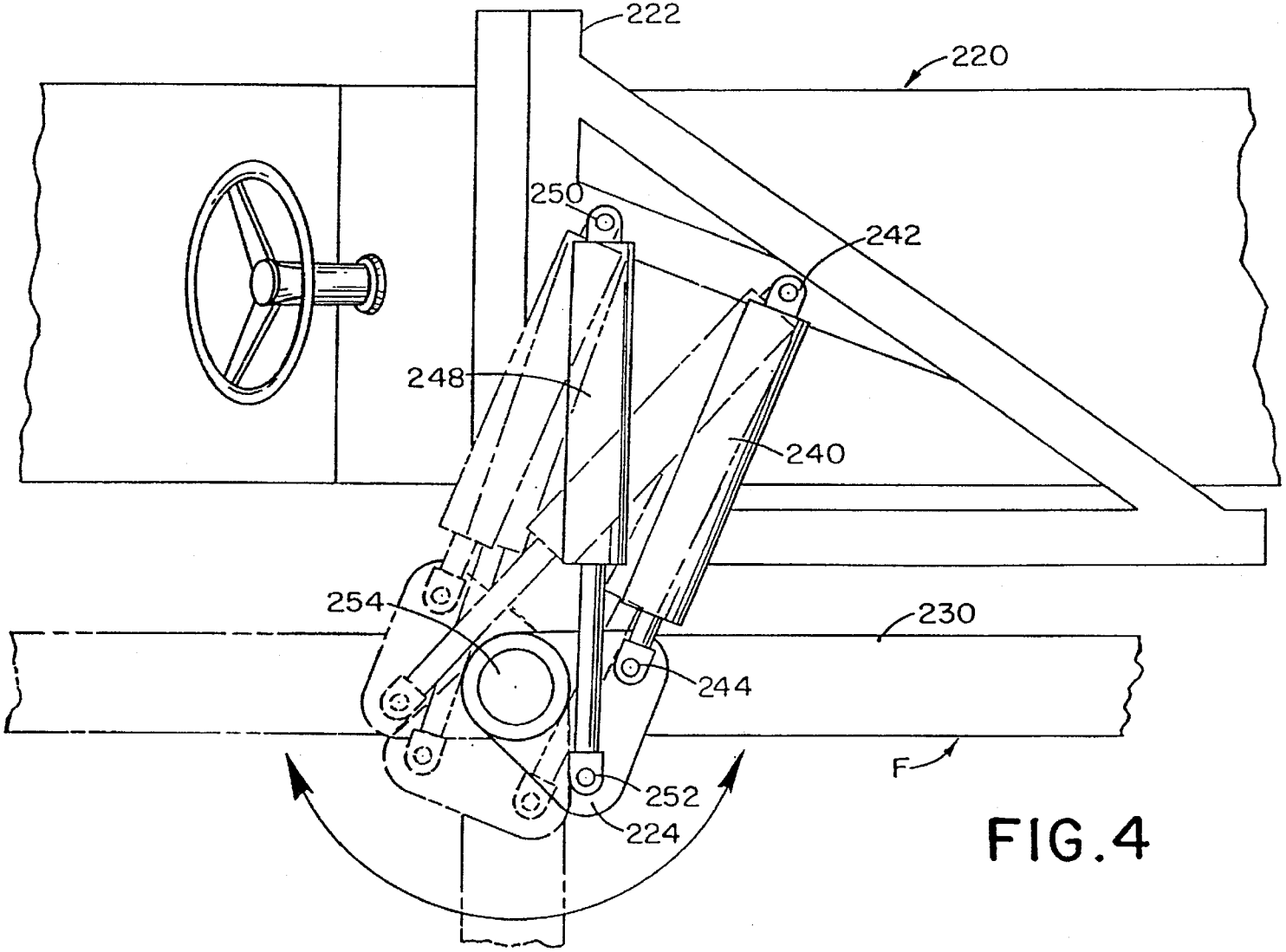
FIG. 4 is an enlarged top plan view of a portion of the vehicle of FIG. 3.

With reference now to FIGS. 3 and 4, a second preferred embodiment of a boom control assembly is there illustrated. The construction includes a vehicle E on which is pivotably mounted a boom assembly F. More particularly, the vehicle E can comprise a tractor 220 which has secured thereon a saddle frame 222 including a vertical mast 224 and a channel frame 226. Secured at one end to the channel frame is a hoist cylinder 228. At its other end, the hoist cylinder is secured to an inner boom arm 230 of the boom assembly F. Provided between the inner boom arm 230 and an outer boom arm 232 is a crowd and retract cylinder 234. Secured to the free end of the outer boom arm is a suitable earth working tool (not illustrated) such as the scraper bucket disclosed in FIGS. 1 and 2 or a similar suitable tool.

With reference now also to FIG. 4, provided for rotating the boom assembly is a first cylinder 240 having a cylinder or first end 242 that is secured to the saddle frame 222 and a piston rod or second end 244 which is secured to one side of the vertical mast 224. Spaced from the first cylinder 240 is a second cylinder 248 which also has a cylinder first end 250 secured to the saddle frame 222 and a piston rod or second end 252 which is pivotably secured to another side of the vertical mast 224. As can be seen, the vertical mast rotates about a vertical axis 254 in relation to the saddle frame 222. The cooperation of the first and second cylinders 240 and 248 enable the boom assembly F to pivot approximately 180° in relation to the vertical axis. Such pivoting is accomplished as the piston rods retract into and extend from the two cylinders 240 and 248 thereby rotating the vertical mast 224 around its axis.

While one suitable hydraulic circuit for actuating a pivoting movement of the boom assembly F was illustrated in FIG. 5, alternative circuit designs exist as well.

Figure 6:
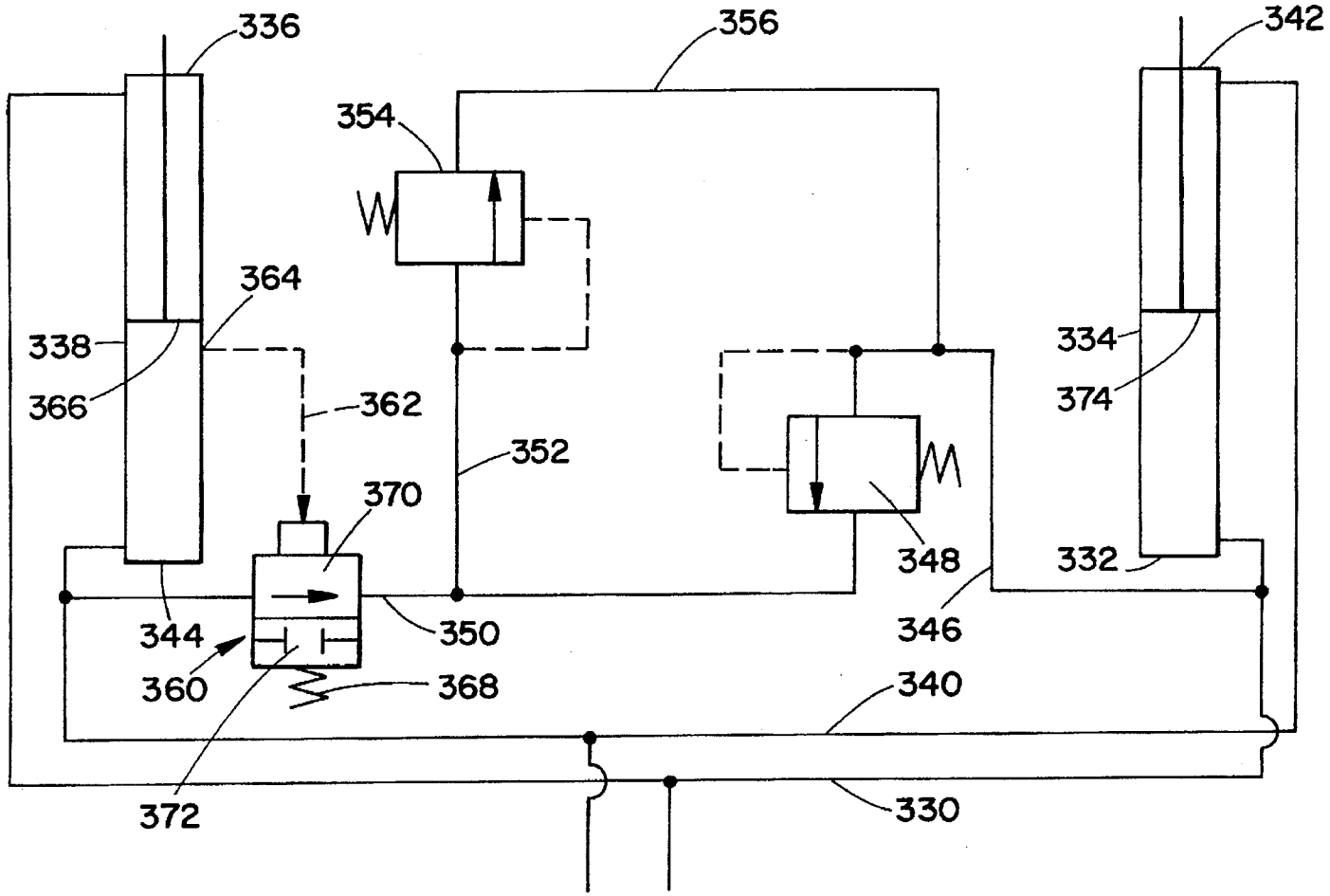
FIG. 6 is a second preferred embodiment of a control means and an overload protection circuit which can be provided for the pair of hydraulic cylinders that are disclosed in FIG. 2 or FIG. 4.

FIG. 6 illustrates a hydraulic circuit in which a first fluid line 330 communicates a cylinder or first end 332 of a first hydraulic cylinder 334 with a piston rod end or second end 336 of a second hydraulic cylinder 338. Also disclosed is a second hydraulic fluid line 340 which communicates a piston rod end or second end 342 of the first cylinder 334 with a cylinder end or first end 344 of the second cylinder 338. Communicating the first and second fluid lines 330 and 340 is a breakaway circuit. In this embodiment, the breakaway circuit is tied to the fluid lines 330 and 340 rather than to the first and second cylinders, as in the embodiment of FIG. 5.

This circuit includes a third fluid line 346 which communicates with the first fluid line 330 on one end and leads to a first relief valve 348 on its other end. The first relief valve, in turn, communicates with a fourth fluid line 350 which is connected at its other end to the second fluid line 340. Communicating with the fourth fluid line 350 is a fifth fluid line 352, at one end of which is located a second relief valve 354. The relief valve, in turn, leads to a sixth fluid line 356 which is connected at its other end to the third fluid line 346.

Positioned in the fourth fluid line 350 is a pressure actuated spring biased valve 360. The valve 360 is actuated by pressurized fluid flowing through a line 362. The line is connected at its first end with a port 364 located on the second cylinder 338, preferably somewhere near the middle of the cylinder. As a piston 366 inside the cylinder 338 descends towards the cylinder's first end 344, hydraulic fluid in the cylinder will be pressurized. This pressurized fluid will act on the valve 360 to keep the valve open. In other words, the pressurized fluid will act against the bias of a spring 368 to keep a first envelope 370 of the valve 360 in fluid communication with line 350. At this time, the breakaway circuit employing valves 348 and 354 is in operation.

However, as the piston 366 advances past the port 364 of the cylinder 338, the pressure of the hydraulic fluid decreases substantially. The hydraulic pressure decreases substantially because the hydraulic fluid on the rear face of the piston 366 is at a considerably lower pressure than is the hydraulic fluid on the front face thereof. The pressure decreases to such an extent that the bias of spring 368 will urge a second envelope 372 of the valve 360 into communication with the line 350 and the first envelope 370 will be pushed out of communication with the line 350. Since the second envelope 372 prevents all flow through line 350, the breakaway circuit will be disabled.

It should be appreciated that while only a single pressure actuated spring biased valve 360 is illustrated in FIG. 6 of the drawings, for selectively disabling the breakaway circuit when the piston 366 advances past the port 364, a similar pressure actuated spring biased valve (not illustrated) could also be located in fluid line 346 and communicate with a port (not illustrated) on the first cylinder 334. In this way, a movement of a piston 374 of the first cylinder 334 would suffice to disable the breakaway circuit when the piston 374 advances towards the cylinder first end 332 past such port. But a single valve, such as the valve 360, suffices to disable the breakaway circuit as it prevents fluid flow through line 350.

It should be appreciated that the first and second fluid lines 330 and 340 communicate with a suitable pump (not illustrated) and sump (not illustrated) through a valve much as in the circuit of FIG. 5.

Figure 7:
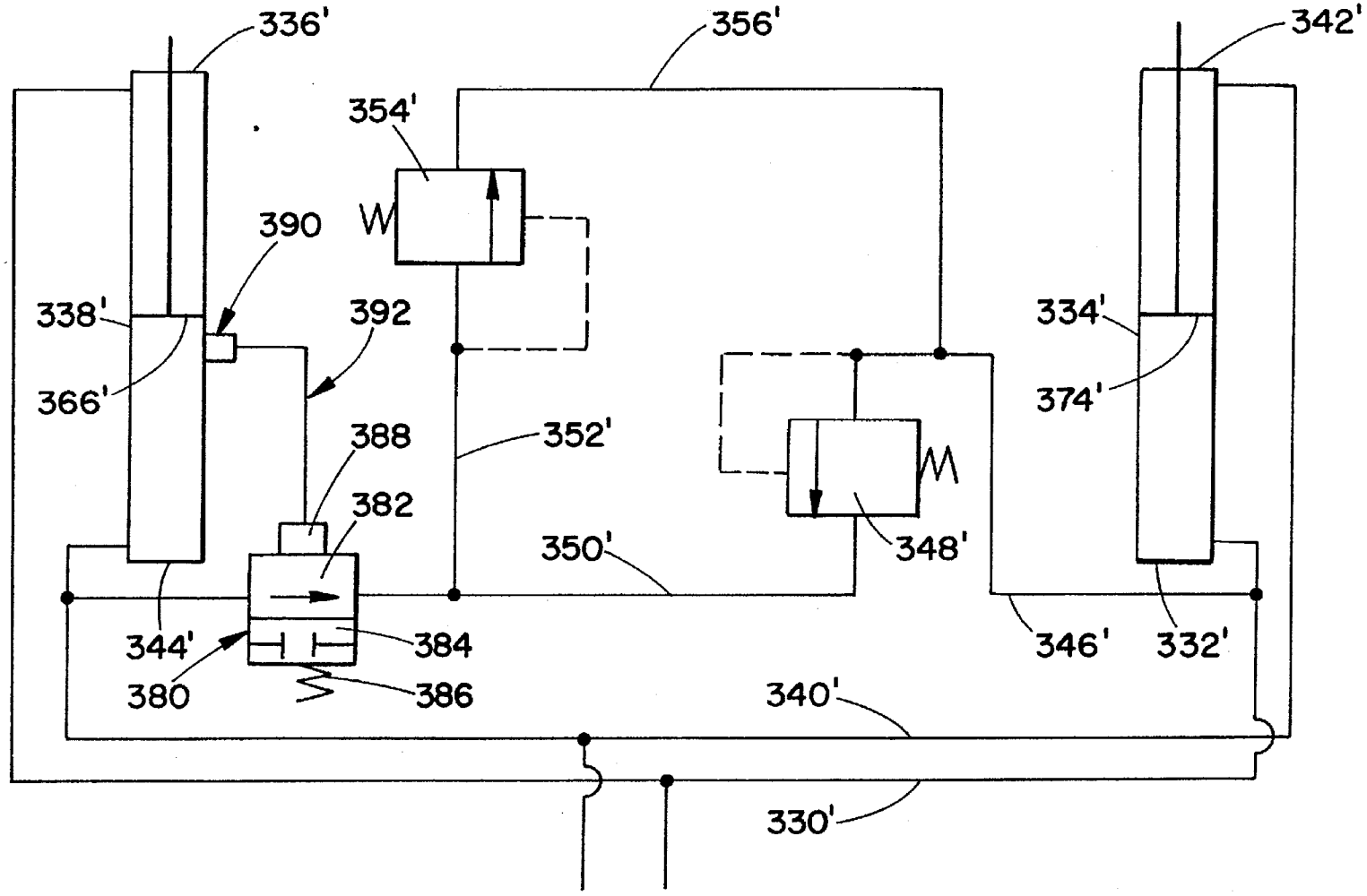
FIG. 7 is a third preferred embodiment of a control means and an overload protection circuit which can be provided for the pair of hydraulic cylinders that are disclosed in FIG. 2 or FIG. 4.

With reference now to FIG. 7, another embodiment of a hydraulic circuit is there illustrated. For ease of illustration and appreciation of this alternative, like components are identified by like numerals with a primed suffix (') and new components are identified by new numerals.

This circuit includes a first fluid line 330' which communicates a cylinder end or first end 332' of a first cylinder 334' and with a piston rod end or second end 336' of a second cylinder 338'. A second hydraulic fluid line 340' communicates a piston rod end or second end 342' of the first cylinder 334' and with a cylinder end or first end 344' of the second cylinder 338'.

This circuit includes a third fluid line 346' which communicates with the first fluid line 330' and leads to a first relief valve 348'. Located on the other side of the first relief valve is a fourth fluid line 350' which is connected at its far end to the second fluid line 340'. Communicating with the fourth line 350' is a fifth fluid line 352' which leads to a second relief valve 354'. Located on the other side of the second relief valve 354' is a sixth fluid line 356' which is connected at its other end to the third fluid line 346'.

For selectively disabling the breakaway circuit so provided, FIG. 7 illustrates the use of a solenoid operated spring biased valve 380. This valve includes a first envelope 382 which allows fluid to flow therethrough and a second envelope 384 which prevents such flow. A spring 386 biases the valve 380 to its second envelope 384 in order to block flow through line 350'. Actuation of a solenoid 388 overcomes the force of the spring 386 and urges the first envelope 382 into communication with the fluid line 350' to allow flow line 350' to allow flow therethrough. The solenoid 388 is activated by a pressure sensor 390.

More specifically, the pressure sensor 390 communicates with the solenoid 388 through an electrical wire 392. The pressure sensor 390 is located over a port (not visible in FIG. 7) located in the second cylinder 338' and senses the hydraulic fluid pressure in the second cylinder. When the pressure is sufficiently high, the solenoid 388 is activated and urges the first valve envelope 382 into communication with the line 350'. The breakaway circuit is thus enabled. When, however, a piston 366' of the cylinder 338' moves past the port over which the sensor 390 is located, the hydraulic fluid pressure sensed by the pressure sensor 390 is reduced to such an extent that the solenoid 388 is deactivated. This then causes the second envelope 384 at the valve 380 to be urged by the spring 386 into communication with the fluid line 350'. Once this occurs, the breakaway circuit is disabled. Therefore, the solenoid operated spring biased valve and pressure sensor combination illustrated in FIG. 7 is operative for selectively disabling the breakaway circuit.

As in FIG. 6, FIG. 7 only illustrates the provision of a single solenoid operated spring biased valve and pressure sensor. It should be appreciated, however, that a similar solenoid operated spring biased valve and pressure sensor could also be provided for the first cylinder 334' to allow the breakaway circuit to be disabled by a movement of a piston 374' in the first cylinder 334'.

The invention has been described with reference to preferred embodiments. Obviously, modifications and alterations will occur to others upon the reading and understanding of the preceding specification. It is intended that the invention be construed as including all such alterations and modifications insofar as they come within the scope of the appended claims or the equivalents thereof.

Having thus described the preferred embodiments, the invention is claimed as follows:

1. A linkage mechanism which allows a substantially 180° pivoting motion of a boom arm around a pivot axis, comprising:

a mast which is pivotably mounted on a pivot axis to an associated support frame, the boom arm being securable at a first end to said mast and supporting on a second end an associated tool;

a first hydraulic cylinder including a piston and a piston rod and having a piston rod end and a cylinder end, one of said piston rod end and cylinder end being pivotably secured to a first side of said mast and the other of said piston rod end and cylinder end being secured to the associated support frame;

a control means connected to said first hydraulic cylinder for effecting a linear movement of said piston rod and a pivotal movement of the mast, and hence the boom arm securable thereto, about the mast's pivot axis;

an overload protection circuit connected to said first hydraulic cylinder such that said mast, and the boom arm, will pivot around said pivot axis in the event the associated tool meets an obstruction, wherein said mast will pivot away from the obstruction in order to avoid damaging the associated tool, said overload protection circuit comprising a first valve; and, a means for disabling said overload protection circuit, wherein said means for disabling comprises:

a second valve, connected to said overload protection circuit, for selectively allowing a flow of hydraulic fluid through said overload protection circuit, and a means responsive to a hydraulic fluid pressure change in said first hydraulic cylinder for actuating said second valve, said means for actuating being connected to both said first hydraulic cylinder and said second valve.

2. The mechanism of claim 1 wherein said overload protection circuit is uni-directional.

3. The mechanism of claim 1 further comprising a second hydraulic cylinder having a piston rod end and a cylinder end, wherein one end of said second hydraulic cylinder is pivotably secured to a second side of the mast and another end of said second hydraulic cylinder is pivotably secured to the associated support frame.

4. The mechanism of claim 1 wherein said second valve comprises a solenoid operated spring biased valve which selectively allows a flow of hydraulic fluid through said overload protection circuit and said means responsive to a pressure change comprises a pressure sensor communicating with a port located on said first hydraulic cylinder, said pressure sensor controlling an activation of a solenoid of said solenoid operated spring biased valve.

5. The mechanism of claim 1 wherein said second valve comprises a pressure actuated spring biased valve which selectively allows a flow of hydraulic fluid through said overload protection circuit and said means responsive to a pressure change comprises a port located on said first hydraulic cylinder and a fluid line communicating said port with said pressure actuated spring biased valve.

6. A road maintenance vehicle comprising:

a support housing mounted on the vehicle;

a mast which is rotatably secured to said housing;

a frame fixedly secured to said mast;

a boom member attached at one end to said frame and adapted to hold a road maintenance tool at another end;

a first hydraulic cylinder including a piston and a piston rod and having a piston rod end and a cylinder end, said piston rod end being pivotably secured to a first side of said mast and said cylinder end being secured to a first side of said support housing;

a hydraulic control circuit in fluid communication with said first hydraulic cylinder;

an overload protection circuit in fluid communication with said first hydraulic cylinder; and, a means for selectively disabling said overload protection circuit, said means for selectively disabling being in communication with said overload protection circuit and comprising said piston and a port located on said first hydraulic cylinder, wherein said port of said means for selectively disabling is so located on said cylinder that said overload protection circuit is only operative when said boom arm is within approximately 20 degrees of a line extending perpendicular to a longitudinal centerline of the vehicle.

7. The vehicle of claim 6 wherein said boom member is pivotably secured to said frame and wherein said boom member's pivot axis is horizontally oriented.

8. The vehicle of claim 7 wherein said boom member comprises a telescoping assembly.

9. The vehicle of claim 6 wherein said overload protection circuit is uni-directional.

10. The vehicle of claim 6 further comprising a second hydraulic cylinder, and wherein said hydraulic control circuit further comprises:

a source of pressurized hydraulic fluid;

a first hydraulic fluid line connecting said source of hydraulic fluid to said first cylinder;

a second hydraulic fluid line connecting said source of hydraulic fluid to said second cylinder; and, a valve means for regulating a flow of hydraulic fluid from said source of hydraulic fluid through said first and second hydraulic fluid lines to actuate a respective piston in each of said first and second cylinders.

11. The vehicle of claim 10 wherein said hydraulic control circuit further comprises a third hydraulic fluid line interconnecting said first and second cylinders.

12. The vehicle of claim 10 wherein said hydraulic control circuit further comprises a fourth hydraulic fluid line connecting said first hydraulic fluid line to a sump and a check valve located in said fourth hydraulic fluid line.

13. The vehicle of claim 6 wherein said overload protection circuit comprises a first hydraulic fluid line having one end secured to said first cylinder between said piston rod end and said cylinder end thereof at said port such that when said piston advances past the location of said first hydraulic fluid line, said overload protection circuit is disabled.

14. The vehicle of claim 6 wherein the frame's pivot axis is vertically oriented.

15. The vehicle of claim 6 wherein said means for disabling comprises:

a solenoid operated spring biased valve which selectively allows a flow of hydraulic fluid through said overload protection circuit; and, a pressure sensor communicating with said port on said first hydraulic cylinder, said pressure sensor controlling an activation of a solenoid of said solenoid operated spring biased valve.

16. The vehicle of claim 6 wherein said means for disabling comprises:

a pressure actuated spring biased valve which selectively allows a flow of hydraulic fluid through said overload protection circuit; and, a fluid line communicating said port on said first hydraulic cylinder with said pressure actuated spring biased valve.

17. The vehicle of claim 6 wherein said means for disabling comprises:

a one-way pressure relief valve which selectively permits hydraulic fluid to flow through said overload protection circuit; and, a fluid line communicating said port on said first hydraulic cylinder with said one-way pressure relief valve.

18. A linkage mechanism which allows a substantially 180° pivoting motion of a boom arm around a pivot axis of a mast mounted on a support frame, the boom arm being securable at a first end to the mast and supporting a tool on a second end, the linkage mechanism comprising:

a first hydraulic cylinder including a piston and a piston rod and having a piston rod end and a cylinder end, one of said piston rod end and cylinder end being pivotably secured to a first side of an associated mast and the other of said piston rod end and cylinder end being secured to an associated support frame;

an overload protection circuit connected to said first hydraulic cylinder such that the associated mast, and an associated boom arm, will pivot around a pivot axis in the event the associated tool meets an obstruction, wherein the associated mast will pivot away from the obstruction in order to avoid damaging the associated tool, said overload protection circuit comprising a first valve in fluid communication with said first hydraulic cylinder; and, a means responsive to a movement of said piston for disabling said overload protection circuit, wherein said means for disabling comprises a second valve which is in fluid communication with said first valve and selectively allows a flow of hydraulic fluid from said hydraulic cylinder through said first valve of said overload protection circuit.

19. The mechanism of claim 18 further comprising a control means connected to said first hydraulic cylinder for effecting a linear movement of said piston rod and a pivotal movement of the associated mast, and hence the associated boom arm secured thereto, about the mast's pivot axis.

20. The mechanism of claim 18 further comprising a second hydraulic cylinder having a pair of opposed ends wherein one end of said second hydraulic cylinder is pivotably secured to a second side of the associated mast and another end of said second hydraulic cylinder is pivotably secured to the associated support frame.

21. The mechanism of claim 18 wherein said means for selectively disabling further comprises a port located on said first hydraulic cylinder, said port being so located on said cylinder that said overload protection circuit is only operative when said boom arm is within approximately 20 degrees of a line extending perpendicular to a longitudinal centerline of an associated vehicle on which the mechanism can be mounted.

* * * * *